United States Patent [19]

Mahoney

[11] Patent Number: 4,899,196

[45] Date of Patent: Feb. 6, 1990

[54] COPY APPARATUS HAVING A NON-INTEGRALLY SIZED TRANSFER DEVICE

[75] Inventor: Gregory P. Mahoney, Fairport, N.Y.

[73] Assignee: Eastman Kodak Company, Rochester, N.Y.

[21] Appl. No.: 313,678

[22] Filed: Feb. 22, 1989

Related U.S. Application Data

[63] Continuation-in-part of Ser. No. 275,828, Nov. 25, 1988, abandoned.

[51] Int. Cl.[4] ..... G03G 15/00; G03G 15/01

[52] U.S. Cl. ..... 355/271; 355/317; 355/327

[58] Field of Search ..... 355/212, 271, 317, 326, 355/327

[56] References Cited

U.S. PATENT DOCUMENTS 4,110,033 8/1978 Ophey ..... 355/210

4,396,275 8/1983 Oka et al. ..... 355/212

4,556,311 12/1985 Tagoka ..... 355/212

*Primary Examiner*—Joan H. Pendegrass

*Attorney, Agent, or Firm*—J. R. Hanway

[57] ABSTRACT

An electrophotographic copier-printer having a continuous intermediate transfer roller. Several color component images are transferred in registration to the intermediate roller and then the composite image is transferred to a hard copy material such as a paper sheet. The images transferred to the intermediate roller come from specific locations on a seamed photoconductive belt. The roller circumference is not an integral fraction of the belt length, thereby allowing the belt position to precess along the roller during component image transfers. The seam of the belt is confined to a precess region between image areas on the roller. This precessing allows the roller to be varied in size by an amount dependent upon the amount of allowed precessing and the number of component images transferred.

15 Claims, 2 Drawing Sheets

FIG. 2
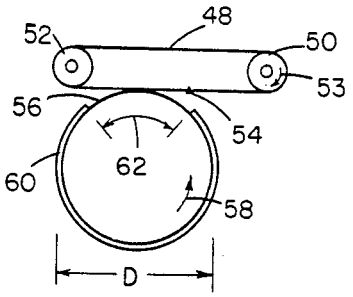
FIG. 3
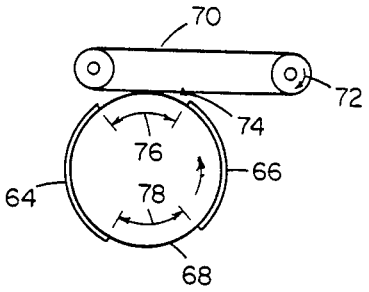
FIG. 4
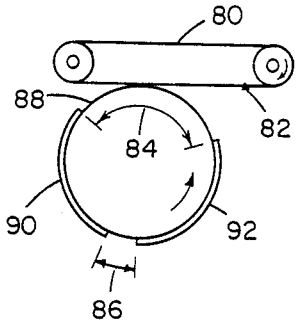
FIG. 5
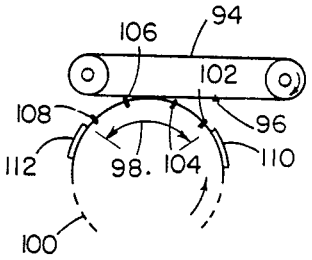
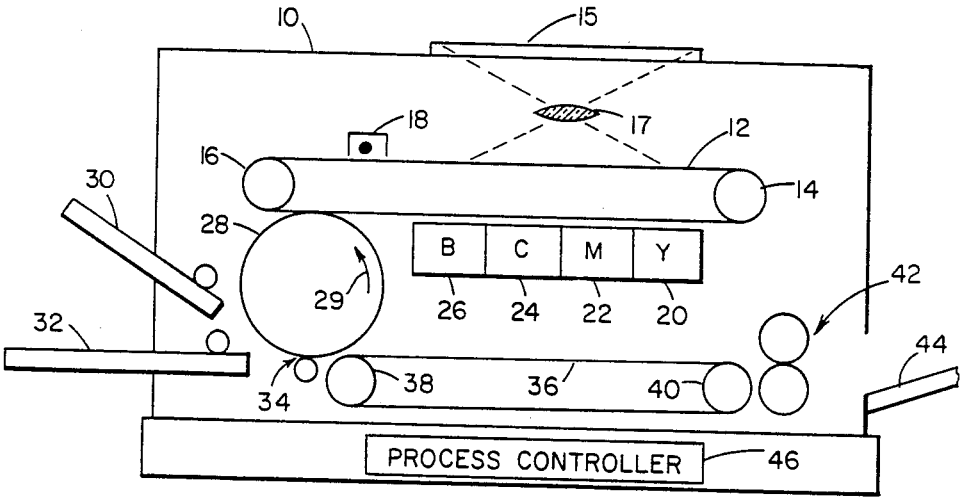
FIG. 1

COPY APPARATUS HAVING A NON-INTEGRALLY SIZED TRANSFER DEVICE

CROSS-REFERENCE TO RELATED APPLICATION

This is a continuation-in-part of earlier filed U.S. patent application Ser. No. 07/275,828, filed on Nov. 25, 1988, now abandoned.

BACKGROUND OF THE INVENTION

1. Field of the Invention

This invention relates, in general, to printers, copiers, duplicators and like devices which provide hard copy outputs and, more specifically, to such apparatus which uses intermediate transfer devices.

2. Description of the Prior Art

Printers, copiers, duplicators, and like devices which use a photosensitive member to develop and transfer an image ultimately to a hard copy output, such as a sheet of paper or transparency, operate and are constructed in several different modes or variations. An intermediate transfer step is used in some apparatus to transfer the images from the photosensitive member to the paper. In this type of apparatus, the image is first transferred to an intermediate roller, drum, or belt, and then transferred from that member to the paper. When color images are being produced by the intermediate process, the traditional method is to register all of the individual color component images on the intermediate transfer device to form the composite or final color image before transfer to the paper. While there are certain advantages to intermediate transfer methods, the components required can affect the size and weight of the machine.

It is usually desirable to keep the size of the intermediate transfer device as small as possible in most applications. However, in other applications, it may be desirable to make the intermediate transfer device larger than usual to allow for other mechanical parts and functions, such as space to install parts on the device or to increase the radius of curvature of the device to make the image more flat. In other cases, it may be desirable to increase the size of a transfer device to allow for placement of other necessary components, such as multiple toner stations in a color copier, in relation to other components or devices in the copier. Whether it be to increase or decrease the size of the intermediate transfer device, it is desirable, and an object of this invention, to provide an apparatus and method whereby the size of the intermediate transfer device may be changed from traditional concepts for improved machine performance and size.

It is conventional practice to make the device which is used to transfer images from the photosensitive member or belt the same effective length as the photosensitive belt, or some whole number fraction of the length of the belt, such as 1/1, 1/2, 1/3, 1/4, or 1/N, where N is any integral number. Usually this device is a roller drum, or belt which has the dimensional restrictions as stated above so that the two devices can be moved at the same speed and the images written thereto are always at the same position on the transfer member. This has been necessary in the past mostly because of mechanical discontinuities in the transfer member which required that the images be placed at a definite position on the transfer device. The practice of sizing the transfer member in an intermediate transfer process to be an integral fraction of the image belt has been carried over from the direct transfer techniques. Since the intermediate transfer member or drum can be continuous without permanently positioned mechanical paper grippers or restricted image areas, the coordination between the movements of the photosensitive belt and the intermediate transfer drum can be modified. This modification to the traditional practice is used in the present invention to permit the sizing changes in the intermediate transfer member to achieve better machine operation and size optimization.

Therefore, it is desirable, and an object of this invention, to provide an apparatus and method which permits the change in size of the intermediate transfer member without affecting the quality of the image transferred to the intermediate member.

SUMMARY OF THE INVENTION

There is disclosed herein a new and useful system for permitting a change in the size of regular or intermediate transfer rollers in hard copy output devices, such as electrophotographic copiers and printers. Instead of fixing the size of the transfer roller or drum to an integral fraction of the photoconductive belt length so that the seam or splice in the belt is always aligned with the same area on the drum, the roller is made slightly smaller or larger. This can be achieved by placing the exposed and developed images on the photoconductor at different distances from the seam. Upon transfer to the intermediate transfer roller, these intermediate color component images are in registration with each other and are subsequently transferred to a paper sheet or other hard copy material. Because of the size relationship and the continuous nature of the roller, the seam alignment position with the roller precesses along the roller during the intermediate image transfer without image degradation or discontinuities. The amount of precession is limited to the interframe distance between the frame areas arranged on the roller for image content. By permitting a change in roller size, the machine can be made more compact with a smaller roller or with a different mechanical design with a larger roller.

BRIEF DESCRIPTION OF THE DRAWING

Further advantages and uses of the invention will become more apparent when considered in view of the following detailed description and drawing, in which:

FIG. 1 is a schematic elevational view of a copier using intermediate transfer technology;

FIG. 2 is a schematic diagram illustrating the operation of the invention with one paper size;

FIG. 3 is a schematic diagram illustrating the operation of the invention with a smaller paper size;

FIG. 4 is a schematic diagram illustrating another arrangement of the invention for use with the smaller paper size;

FIG. 5 is a schematic diagram illustrating the precessing which occurs between the two image surfaces.

DESCRIPTION OF THE PREFERRED EMBODIMENTS

Figure 6A:
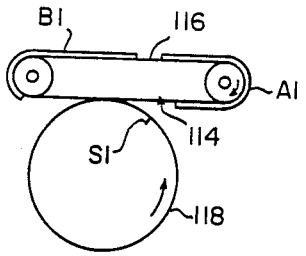
FIGS. 6A, 6B, 6C and 6D illustrate, in sequence, the precession between the image surfaces for a complete four-step transfer.

Throughout the following description, similar reference characters refer to similar elements or members in all of the figures of the drawing.

Referring now to the drawing, and to FIG. 1 in particular, there is shown a copy machine capable of producing color copies from an original document by use of the intermediate transfer process. The copier 10 includes a photosensitive member 12 which can be rotated or moved by the rollers 14 and 16. The member 12 may be any of the photoconductive surfaces customarily used in the copier art, although other forms of image reproduction apparatus may be used within the contemplation of the invention, such as electrostatic image formation. According to the copier 10 shown in FIG. 1, the original is placed upon the platen 15 where it is imaged onto the photosensitive member 12 by a lens assembly, which is shown in FIG. 1 as the simple lens 17. A primary charger 18 is used to initially charge the photosensitive member 12 and the toner stations 20, 22, 24 and 26 are used to develop the latent image contained on the member 12. The toner stations contains toner of the color components cyan, magenta, and yellow and a black toner for enhanced contrast and monochrome copies.

The copier shown in FIG. 1 operates with the intermediate transfer process wherein the image developed on the endless photosensitive member, web, or belt, 12 is transferred to an intermediate member before being transferred to the copy sheet. In FIG. 1, the intermediate transfer roller 28 rotates synchronously in direction 29 with the movement of the belt 12 and receives each of the separate color images in registration before the composite or final image is transferred to a sheet of paper fed from paper assembly 30 or 32. Transfer from the roller 28 to the sheet of paper occurs when the sheet of paper enters the transfer area 34 below the intermediate transfer roller 28. The roller 28 is of the continuous, non-seamed surface type. Once the image is transferred to the paper, the paper is conveyed by the conveyor belt 36, which rotates on the rollers 38 and 40, to the fuser station 42. After the fusing operation, which fixes the toner particles on the flat paper sheet, the paper exits the copier and is deposited in the tray 44. The process controller 46, along with other apparatus such as motors, synchronizes and controls the various functions of the copier, including the speed of rotation and movement of the belt 12 and of the intermediate transfer roller 28.

The invention disclosed herein is useful when the length of the belt 12 and the number of intermediate images needed to construct the composite image is such that the belt 12 must rotate more than one complete revolution to deposit all of the intermediate images upon the intermediate transfer roller 28. Since the belt 12 shown in FIG. 1 is effectively longer than the surface of the intermediate transfer roller 28, the invention is applicable to the copier shown in FIG. 1 when the number of images which form the final image cannot be placed simultaneously upon the belt 12 because of lack of space thereon. In other words, the belt 12 must be rotated more than one complete revolution to provide the surface area needed to hold or position to intermediate images necessary to construct the composite image.

The invention as disclosed herein is especially useful when the photosensitive member, or belt, 12 is relatively short compared to the circumference of the intermediate transfer roller 28. In such case where the belt 12 is relatively small, it may be even more important that the dimensions of the transfer roller be optimized for reduced machine size. Therefore, the invention, although useful with a machine having a long photosensitive member as shown in FIG. 1, is very useful when the belt and the transfer drum have relative lengths which are more equal that that shown in FIG. 1, as shown by the belt and transfer drum arrangement of FIG. 2. One practical example of dimensions exists when it is desired to make the belt 12 thirty inches long to allow for space to position development stations, but keep the circumference of the roller smaller than thirty inches to conserve space.

Although the invention is described primarily with an intermediate transfer device, a direct transfer process can also utilize the teachings of the invention. With direct transfer, the sheet which receives the developed images from the photosensitive member is attached directly to a transfer drum constructed and located similar to the intermediate transfer drum. The difference, of course, is that the sheet remains on the drum for more than one revolution to receive all of the images from the photosensitive member. Using a vacuum sheet holding system on the transfer drum can allow the sheet to be placed at various positions on the drum, thus permitting easy and efficient alignment of the paper for image transfer from the photosensitive member.

According to FIG. 2, the belt 48 rotates around rollers 50 and 52 in direction 53. As is typical with photosensitive belts, the belt 48 contains a seam, or joint, 54 which provides an area of the belt in which images cannot be satisfactorily positioned. Because of the seam 54, synchronization of the movement of the belt 48 is necessary with respect to the movement or rotation of the intermediate transfer roller 56 in direction 58. This is because the roller 56 must make several revolutions to acquire the intermediate images on the belt 48 and the seam 54 must not enter into the image area on the roller 56.

According to FIG. 2, the image area 60 of the transfer roller 56 extends around the majority of the surface area of the roller 56. In other words, the image area 60 contains the areas, or frames, upon which developed images from the belt 48 can be deposited on the roller 56 without the seam 54 affecting the quality of the transferred images. According to normal and a conventional practice, the registration or alignment of the seam 54 with the surface of the roller 56 would be maintained during each revolution of the roller 56. However, the invention makes use of the distance 62 between the ends of the image area 60 by allowing the seam 54 to precess along this distance during each successive transfer of the intermediate images to the roller 56. By allowing the precession, the roller 56 need not be the same effective length, or circumference, as the effective length of the belt 48, or an integral fraction thereof, since the seam 54 does not have to meet the roller 56 at the exact same position during each transfer.

FIGS. 2, 3 and 4 will be used to analyze the ability of the invention to permit a change in the size or diameter of the transfer roller 56. FIG. 2 illustrates the case when a large paper sheet is to be imaged with a full size image. FIG. 3 illustrates the use of the invention when two smaller images are being transferred, and FIG. 4 illustrates the arrangement when two smaller images are being transferred with different gaps or distances between the image areas on the drum. It is emphasized that the image areas, or frames, on the transfer drums may be used for the entire image or for a plurality of smaller images. Many copy machines are constructed to handle both $8\frac{1}{2}\times 11''$ paper and $11\times 17''$ paper, since there is the exact two-to-one relationship between the two sizes. This allows the transfer components of the copier to be sized for the larger transfer and, when transfer is being made of the smaller sizes, two of the smaller sizes can be accommodated in the same space as one of the larger sizes. In this regard, the image area or frames allocated to the transfer rollers are usually regarded as the frame area needed to contain an image destined for a smaller sheet. Thus, the intermediate transfer roller would contain two image areas, or frames, capable of being used separately when the smaller sheets are being copied and capable of being used together when the larger sheets are being copied. Consequently, the image area 60 shown in FIG. 2 actually comprises two image areas, or frames, which are illustrated separately, and in different positions, in the arrangements shown in FIGS. 3 and 4.

According to FIG. 2, the image area 60 is dimensioned to handle one 11×17" image. The diameter D of the drum 56 is related to the interframe distance 62, or I, by the equation:

$$C=17+I, \tag{1}$$

where C equals the circumference of the drum 56, and the total frame area is 17" long. Assuming that the length L, of the belt 48 is equal to the circumference C, then:

$$L=17+I \text{ and} \tag{2}$$

$$D=C/\pi=L/\pi. \tag{3}$$

Therefore, $L/\pi$ represents the diameter of the drum 56 needed to synchronize the seam 54 at the same position on the roller 56 each time it rotates.

To change the size of the roller 56, precessing the seam 54 through the interframe distance 62 during each revolution would be necessary. The amount of precessing of the seam through the distance I, or 62, is dependent upon the length of the interframe area and the number of intermediate images needed to form the final image. In this embodiment, four separate intermediate images are needed to construct the final composite image, which can be a color image constructed of three color component images plus a black image. Thus, the four intersections of the seam 54 with the roller 56 effectively divide the interframe area I into three equal components, or I/3. By taking into consideration the precessing of the seam through the interframe area, the circumference of the transfer roller can be reduced according to the equation:

$$C=L-I/3. \tag{4}$$

For the dimensions given, this yields:

$$L=17+I+I/3 \text{ or} \tag{5}$$

$$L=17+4/3\ I. \tag{6}$$

Therefore, $$I=(\tfrac{3}{4})(L-17) \text{ and} \tag{7}$$

$$C=17+[(\tfrac{3}{4})(L-17)] \text{ or} \tag{8}$$

$$C=17/4+3L/4 \text{ or} \tag{9}$$

$$C=(17+3L)/4. \tag{10}$$

Substituting equation 10 into equation 3 provides the diameter of:

$$D=C/\pi=(17+3L)/4\pi. \tag{11}$$

Equation 11 represents the minimum or lower bound of the diameter of the drum 56 which may be realized by the precession of the seam 54 through the distance 62 during the intermediate image transfers. The effective length of the belt is the total belt length, including the seam area, and the effective length of the intermediate transfer roller is the circumference of the roller.

By assuming a 30" belt length for the belt 48, the diameter of the transfer roller 56 becomes 8.51". The diameter of the roller 56 without any precession, according to equation 3, would be 9.55". Thus, it can be seen that a reduction of over 1" in the diameter of the transfer roller 56 can be realized when the seam 54 is allowed to precess through the interframe distance 62 in a direction which effectively adds to the circumference of the roller 56. If the seam is allowed to precess in the opposite direction, which effectively decreases the length of the circumference of the roller 56, it would be necessary to increase the diameter of the roller 56 to permit proper registration of the intermediate images and to prevent the seam from precessing into the frame areas. With the dimensions assumed, the large diameter would be equal to 10.59 inches.

FIG. 3 illustrates the use of the invention when the copy machine is arranged to make the smaller of the two copy sizes, thereby utilizing two independent image areas, or frames, 64 and 66 on roller 68. The belt 70 rotates in direction 72 in this example and the seam 74 precesses through the interframe area, or distance 76. In this arrangement, the interframe area 76 is located between the image frames 64 and 66 in addition to an interframe area between the other ends of the image areas 64 and 66. However, the other interframe area, or area 78, is not of use in providing an area for the seam 74 to precess within. The equation for the diameter of the drum 56 according to the arrangement shown in FIG. 3 having equal interframe distances between two separate image areas is represented by:

$$D=C/\pi=(6L+17)/7\pi \tag{13}$$

When the assumed values used with regard to FIG. 2 are used, the diameter of the roller 68 becomes 8.96 inches.

A greater decrease in roller diameter is afforded by the arrangement shown in FIG. 4. According to FIG. 4, the belt 80 is moved to allow the seam 82 to precess through the interframe distance 84. Since the interframe distance 84 is greater than the interframe distance 86, and larger than the interframe distance 76 shown in FIG. 3, the reduction in the diameter of roller 88 is greater than that shown in FIG. 3. The arrangement shown in FIG. 4 uses two separate image areas or frames 90 and 92 which are separated by different interframe areas, or distances when viewed as a two dimensional figure.

FIG. 5 illustrates the precession of the seam in the belt across the interframe area on the transfer roller. As shown in FIG. 5, the belt 94 includes the seam 96 which precesses across the interframe distance 98 of the transfer roller 100. Markers 102, 104, 106 and 108 represent the positions at which the seam 96 aligns with and contacts the roller 100 when the seam precesses through the distance 98 during four transfers from the belt 94 to the roller 100. Although exaggerted in FIG. 5, the distances between the marks 102 and 108 and their adjacent image areas 110 and 112, respectively, are kept as small as possible to enhance the ability to change the diameter of the roller 100. In other words, the distance between the outer markers representing the seam contacts with the roller 100 with the adjacent image areas would be as small as practicable so that the entire interframe distance is usable. The precession shown in FIG. 5 from mark 108 to mark 102 is the sequence used when the roller is desired to be made smaller. If the roller is desired to be made larger than would be realized by making the roller 100 an integral fraction of the length of the belt 94, the precession would proceed from mark 102 to mark 108. In other words, the first image would be applied to the roller 100 when the seam was at position 102 and the last image would be applied when the seam 96 was at position or mark 108, three revolutions later of the belt 94.

FIGS. 6A, 6B, 6C and 6D illustrate the precession of the seam contact or alignment areas across the interframe area of the roller when the copier is transferring four intermediate images to the transfer roller 118 which is larger than an integral fraction of the length of the belt 116. According to FIG. 6A, the seam 114 of belt 116 will first contact, or be adjacent to, the marker S1 on roller 118. It is assumed that the belt 116 is sufficiently large enough to include two separate image areas thereon, with the first image area A1 being positioned for transfer to the roller 56 as the first intermediate image of the desired final or composite image. Thus, mark S1 represents the first location of the seam 114 on the roller 118.

Figure 6B:
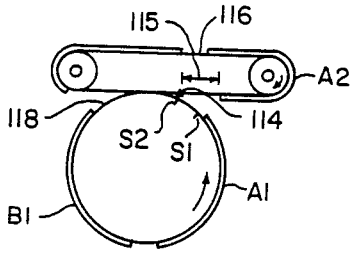

FIG. 6B represents the belt and roller devices immediately before the start of the second transfer of an intermediate image A2 from the belt 116 to the roller 118. As shown, the first intermediate image A1 is already contained or deposited on the transfer roller 118. Seam 114 is positioned to intersect the roller 118 at position S2. The next image to be transferred, image A2 on belt 116, is appropriately positioned behind the seam 114 a distance 115 to properly align and register with the image area A1 already contained on roller 118. Image area B1 contains image B1 from the belt 116 shown in FIG. 6A. Because the roller 118 is large enough to include two frame areas which are both used for a large image, two separate images can be constructed when they are of the smaller size.

Figure 6C:
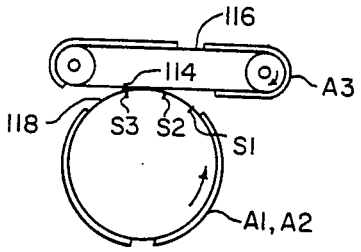
Figure 6D:
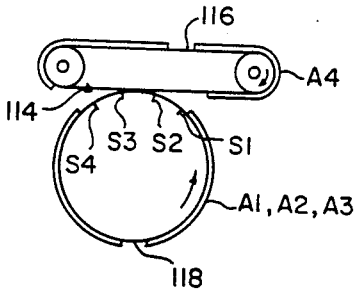

The next transfer is shown by FIG. 6C which indicates that the third intermediate image A3 is transferred in registration upon the combined image areas A1 and A2 on roller 118. Seam 114 aligns with position S3 at the beginning of this transfer. The final transfer of the fourth image, A4, is shown in FIG. 6D. Similarly, the seam 14 was in contact with the mark S4 on roller 118 when the two members were touching each other. The image A4 will be transferred, in registration, to the roller 118, to form a composite image consisting of intermediate images A1, A2, A3 and A4. As can be seen by FIGS. 6A through 6D, the precession of the seam 114 in this sequence goes from position S1 to S4, which is across the larger interframe area between the two image areas contained on the transfer roller 114. This precession allows for an increase in the size of the transfer roller compared to what would be required if the seam area was to contact the transfer roller at the same position during each intermediate transfer.

Note that the images on the belt 116 have been properly positioned with reference to the belt seam 114 so that they will properly register with the other images transferred to the drum 118. For the larger drum diameter case shown in FIGS. *6a–6d*, the later transferred images on the belt are displaced further from the seam 114 than the earlier images on the belt 116. In the event the drum 118 shown in FIGS. *6a–6d* is dimensioned for the smaller diameter case, the precession would occur from position S4 to S1 and the earlier transferred images are displaced farther from the seam 114.

The invention disclosed herein permits the utilization of a transfer roller which can be varied in size to accomplish a desired result. In certain cases the roller may be made slightly larger than that allowed by a fixed and synchronized seam contact system. When it is desired, it is possible to decrease the diameter of the regular or intermediate transfer roller to provide a smaller roller than is possible according to the prior art. It is emphasized that numerous changes may be made in the abovedescribed system without departing from the teachings of the invention. It is intended that all other matter contained in the foregoing description, or shown in the accompanying drawing, shall be interpreted as illustrative rather than limiting.

I claim as my invention:

1. Copy apparatus for placing final images onto flat sheets, with the final images consisting of a plurality of intermediate images, said apparatus comprising:

an image carrying surface arranged in the form of an endless belt containing a seam across the surface of the belt;

means for placing a plurality of toned intermediate images onto the image carrying surface;

a continuous, non-seamed surface closely positioned to said image carrying surface;

means for transferring the intermediate images from the image carrying surface to the continuous surface in registration to form a final image, and for transferring the final image on the continuous surface to a flat sheet, said continuous surface being arranged to include at least one frame area for accepting the transferred image and at least one interframe area; and means for controlling the movement of said two surfaces such that the seam of the image carrying surface precesses through the interframe area of the continuous surface during the plurality of intermediate image transfers between the two surfaces.

2. The copy apparatus of claim 1 wherein the image carrying surface has an effective length which is insufficient to simultaneously hold all of the intermediate images, thereby requiring more than one revolution of the image carrying surface to transfer the intermediate images to the continuous surface.

3. The copy apparatus of claim 1 wherein the effective length of the continuous surface does not have a whole number fractional relationship with the effective length of the image carrying surface.

4. The copy apparatus of claim 1 wherein the continuous surface is disposed around a cylindrical roller which is controlled to rotate at the same linear speed as the image carrying surface.

5. The copy apparatus of claim 4 wherein the diameter of the roller is slightly smaller than a roller having a circumference which is a whole number fraction of the effective length of the image carrying surface.

6. The copy apparatus of claim 4 wherein the diameter of the roller is slightly larger than a roller having a circumference which is a whole number fraction of the effective length of the image carrying surface.

7. The copy apparatus of claim 5 wherein the size difference in the rollers depends on the length of the interframe area and the number of intermediate images needed to form the final image.

8. The copy apparatus of claim 5 wherein the transfer of the first of the intermediate images to the continuous surface to form a part of the final image begins with said seam not adjacent to said first intermediate image.

9. The copy apparatus of claim 6 wherein the transfer of the first of the intermediate images to the continuous surface to form a part of the final image begins with said seam adjacent to said first intermediate image.

10. Copy apparatus for placing final color images onto flat sheets, with each final color image consisting of a plurality of intermediate overlaid component images, said apparatus comprising:

an image carrying surface arranged in the form of an endless belt containing a seam across the surface of the belt, said surface having an effective length which is insufficient to simultaneously hold all of the intermediate images;

means for placing a plurality of toned intermediate images onto the image carrying surface;

a continuous, non-seamed surface closely positioned to said image carrying surface, with the effective length of the continuous surface not having a whole number fractional relationship with the effective length of the image carrying surface;

means for transferring the intermediate images from the image carrying surface to the continuous surface in registration to form a final image, and for transferring the final image on the continuous surface to a flat sheet, said continuous surface being arranged to include at least two frame areas separated by at least one interframe area; and means for controlling the movement of said two surfaces such that the seam of the image carrying surface precesses through the interframe area of the continuous surface during the plurality of intermediate image transfers between the two surfaces, with said precession substantially equal in distance to the length of the interframe area.

11. A method for transferring toned color component images from an endless photo sensitive belt to an intermediate transfer device, said belt having an area which is unsuitable for image transfer, said method including the steps of:

rotating the belt at a first linear speed;

rotating the transfer device at the same linear speed as the belt;

selecting the effective lengths of the belt and of the transfer device such that more than one revolution of the transfer device is necessary to receive all of said color component images, with the lengths not having a whole number fractional relationship with each other; and initiating the transfer of an image in registration from the belt to the transfer device every time the transfer device moves a distance equal to its effective length.

12. The method of claim 11 including the step of varying the placement of the component images on the belt with respect to the unsuitable transfer area.

13. A method for transferring toned color component images from an endless photo sensitive belt to an intermediate transfer device, said belt having an area which is unsuitable for image transfer, said method including the steps of:

placing one of the toned images on the belt beginning at a first determined distance from said unsuitable area;

transferring said one toned image to the transfer device;

placing another of the toned images on the belt beginning at a second and different predetermined distance from said unsuitable area;

transferring said other toned image to the transfer device and in registration with said one toned image;

selecting the effective lengths of the belt and of the transfer device such that more than one revolution of the transfer device is necessary to register both of said color component images, with the lengths not having a whole number fractional relationship to each other; and moving the belt and the device at the same linear speed thereby causing the unsuitable area to precess along the intermediate transfer device between each component image transfer.

14. A method for transferring toned color component images from an endless photosensitive belt to a sheet disposed on a transfer drum, said belt having an area which is unsuitable for image transfer, said method including the steps of:

rotating the belt at a first linear speed;

rotating the transfer drum at the same linear speed as the belt;

selecting the effective lengths of the belt and of the transfer drum such that more than one revolution of the transfer drum is necessary to receive all of said color component images, with the lengths not having a whole number fractional relationship with each other; and initiating the transfer of an image in registration from the belt to the sheet every time the transfer drum moves a distance equal to its effective length.

15. The method of claim 14 including the step of varying the placement of the component images on the belt with respect to the unsuitable transfer area.

* * * * *